US006034647A

United States Patent [19]

Paul et al.

[11] Patent Number: 6,034,647

[45] Date of Patent: Mar. 7, 2000

[54] BOXHORN ARRAY ARCHITECTURE USING FOLDED JUNCTIONS

[75] Inventors: Jeffrey A. Paul, Torrance; Raymond Santos, Long Beach, both of Calif.; John M. Seavey, Cohasset, Mass.

[73] Assignee: Raytheon Company, Lexington, Mass.

[21] Appl. No.: 09/006,251

[22] Filed: Jan. 13, 1998

[51] Int. Cl.[7] ..... H01Q 13/02

[52] U.S. Cl. ..... 343/776; 343/772; 343/778; 343/786

[58] Field of Search ..... 343/778, 786, 343/772, 776; H01Q 13/02

[56] References Cited

U.S. PATENT DOCUMENTS

| | | | |
|---|---|---|---|
| 3,576,579 | 4/1971 | Appelbaum et al. | 343/854 |
| 3,877,031 | 4/1975 | Mailloux et al. | 343/778 |
| 4,523,198 | 6/1985 | Clapp | 343/754 |
| 4,707,702 | 11/1987 | Withers | 343/786 |
| 4,743,915 | 5/1988 | Rammos et al. | 343/776 |
| 4,959,658 | 9/1990 | Collins | 343/786 |
| 5,557,286 | 9/1996 | Varadan et al. | 343/700 MS |

FOREIGN PATENT DOCUMENTS

| | | |
|---|---|---|
| 0228742 A1 | 7/1987 | European Pat. Off. . |
| 0570863 A2 | 11/1993 | European Pat. Off. . |
| 2219143 | 11/1989 | United Kingdom . |

*Primary Examiner*—Don Wong
*Assistant Examiner*—Shih-Chao Chen
*Attorney, Agent, or Firm*—Leonard A. Alkov; William C. Schubert; Glenn H. Lenzen, Jr.

[57] ABSTRACT

An inverted boxhorn antenna array comprising a power divider that is constructed from a single metal piece and a flat metal sheet that is fastened to a rear surface of the power divider. The power divider is fabricated using a variety of waveguide junctions coupled between substantially identical inverted boxhorn subarrays. The junctions includes a central magic tee junction for coupling energy from an input port into the power divider. Alternating folded shunt and folded series tee junctions are used to transfer power coupled by way of the central series junction to the inverted boxhorn subarrays. Specially dimensioned folded shunt and series tee junctions are used in the inverted boxhorn subarrays. Waveguide matched loads are bonded in waveguides between each of the inverted boxhorn radiators of the subarrays. A fully functional antenna assembly includes a radome cover, a quadrature correction plate 18*a*, and a twist polarizer disposed in front of radiating elements of the inverted boxhorn antenna array.

17 Claims, 4 Drawing Sheets

BOXHORN ARRAY ARCHITECTURE USING FOLDED JUNCTIONS

BACKGROUND

The present invention relates generally to antenna arrays, and more particularly, to an inverted boxhorn antenna array.

One conventional antenna array is known as a boxhorn array, which is a particular arrangement of boxhorn antenna elements placed in rectangular arrays or in echelon arrays that are fed from a true-time-delay waveguide corporate power divider. The boxhorn antenna elements may be flared in the E-plane. Dielectric loading may be employed to reduce the size of the boxhorn array. The boxhorn array may also be formed using a plurality of arrays. Although normally uniformly excited, tapered amplitude and phase designs may be made. The main beam generated by the boxhorn array is normal to the face of the array at all frequencies, and thus the array has no beam squint. Boxhorn elements were first developed during World War II and their design parameters were reported in a book by S. Silver entitled "Microwave Antenna Theory and Design" published by McGraw-Hill, 1949, pp. 377–380.

Boxhorn arrays are linearly polarized along one of the principal axes of the array. For low sidelobe line-of-sight microwave communications applications, such arrays are typically equipped with 45-degree transmission-type twist polarizers. These polarizers rotate the plane of polarization into a diagonal plane. When the array is mounted with the diagonal oriented horizontally, the horizontal plane sidelobes are greatly improved and the resulting antenna complies with demanding international specifications for horizontal plane sidelobes. Frequency ranges of such boxhorn arrays are typically 2–40 GHz. Bandwidths up to 12 percent can be accommodated.

Typically, the boxhorn array includes two metal components, a one-piece array face containing the boxhorn antenna elements and a one-piece power divider. In this case, the two components are fastened together with screws. This is known as and is referred to herein as a standard boxhorn array. However, in certain applications, it would be desirable to further reduce the size of the boxhorn array.

Furthermore, the heart of the boxhorn array is the power divider (or combiner). In typical boxhorn arrays having gains in the 35–43 dBi range, power dividers from 512-way to 4,096-way are required. Design and fabrication of such dividers presents great difficulties in performance, fabrication tolerances and production costs of conventional boxhorn arrays. It would be advantageous to have a boxhorn antenna structure that minimizes the complexity of the power dividers used therein.

Accordingly, it is an objective of the present invention to provide for an inverted boxhorn antenna array that overcomes limitations found in conventional boxhorn arrays. It is another objective of the present invention to provide for an inverted boxhorn antenna array that has reduced size compared to the standard boxhorn array. It is yet another objective of the present invention to provide for an inverted boxhorn antenna array that minimizes the complexity of the power dividers used therein.

SUMMARY OF THE INVENTION

To accomplish the above and other objectives, the present invention provides for an inverted boxhorn antenna array comprising two components. The first component comprises a power divider that includes a radiating surface of the array and which is constructed from a single metal component. The second component comprises a flat sheet of metal that is fastened with screws to a rear surface of the power divider to complete the array.

The power divider is fabricated using a variety of different junctions coupled between substantially identical inverted boxhorn subarrays. The junctions includes a central series junction for coupling energy from a single input port in the flat sheet of metal along two input paths of the power divider. The plurality of first folded series junctions are used to transfer power coupled by way of the central series junction along two opposed transverse paths of the power divider. A folded shunt junction is disposed at junctions between inverted boxhorn subarrays. A plurality of second folded series junctions are used to couple energy to the inverted boxhorn radiators of the inverted boxhorn subarrays. Waveguide matched loads (comprising ferrite or other resistive material) are bonded in the waveguide channels of the power divider between each of the inverted boxhorn radiators of the inverted boxhorn subarrays.

The H-plane width of the boxhorn elements is critical to the element pattern. Normally, the width is fixed for a given frequency of application, thus fixing the H-plane width of the entire array. Dielectric loading of the boxhorn array results in a different propagation velocity for $TE_{10}$ and $TE_{30}$ modes which are the only modes that propagate in the boxhorn array.

A low dielectric constant material such as foam having a relative permittivity of 1.05 to 1.10, for example, may be used to reduce the width of the array by approximately the inverse square root of the relative permittivity. This technique allows the array to be dimensioned to meet particular size and volume requirements.

The present invention allows antennas to be manufactured that are significantly thinner in size than commercially available parabolic dish antennas and at a lower cost. This architecture of the present invention allows this small compact antenna to meet the regulatory requirements for gain, beamwidth, sidelobes and backlobes. The present antenna is also compact and is physically unobtrusive when installed in environments that require an aesthetic radio installations.

The present invention may be used in radio products developed by the assignee of the present invention. One of the distinguishing features of these radio products are the small, flat profile antenna that is integrated with the radio. This feature is not currently present in competitive products. Customer supplier selection of a particular radio is based upon performance and esthetic appeal. The present invention allows both of these criteria to be embodied in the antenna offered with the radio.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
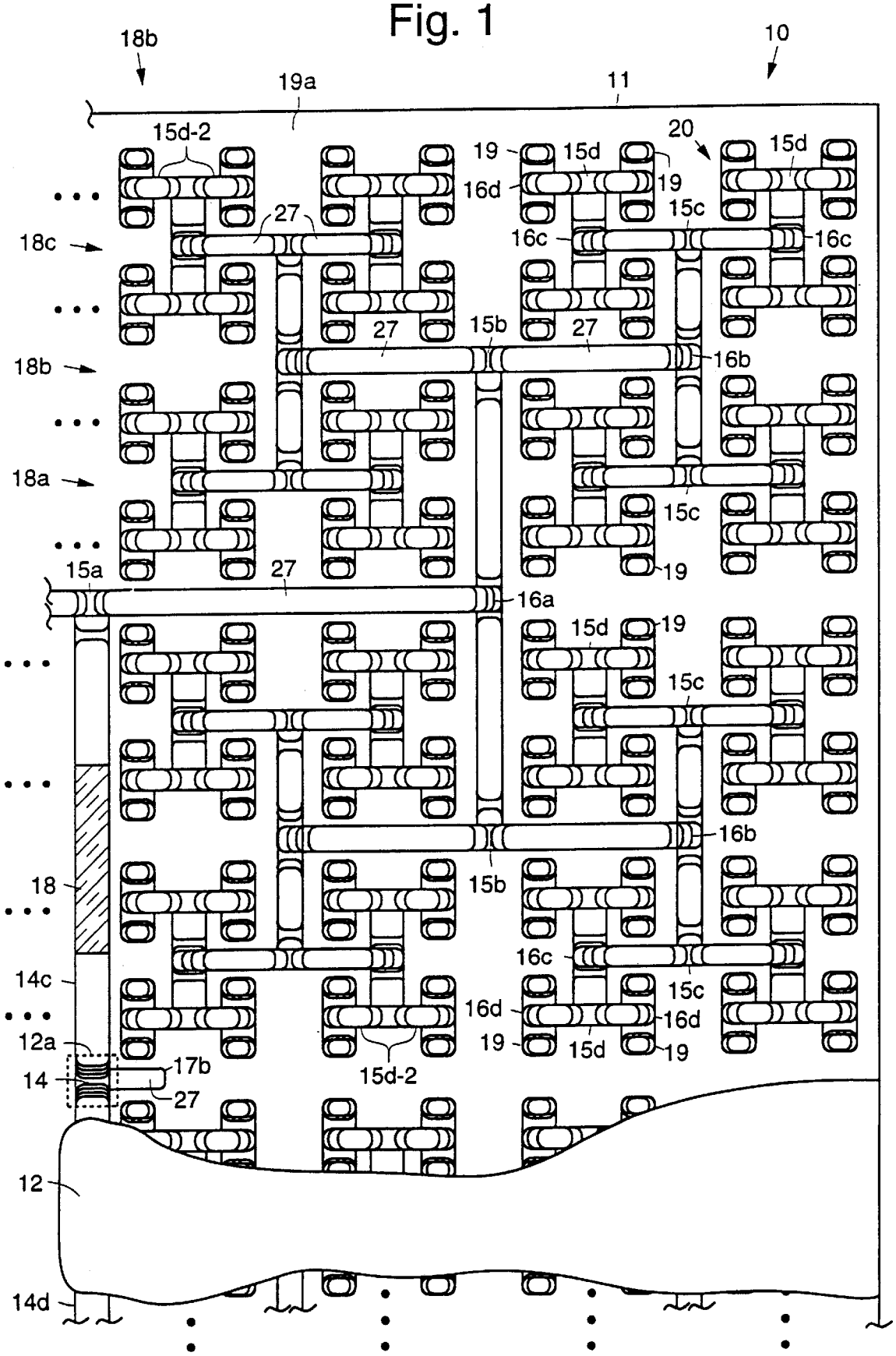
FIG. 1 illustrates a rear view of a portion of an inverted boxhorn antenna array in accordance with the principles of the present invention with its cover removed.
Figure 2:
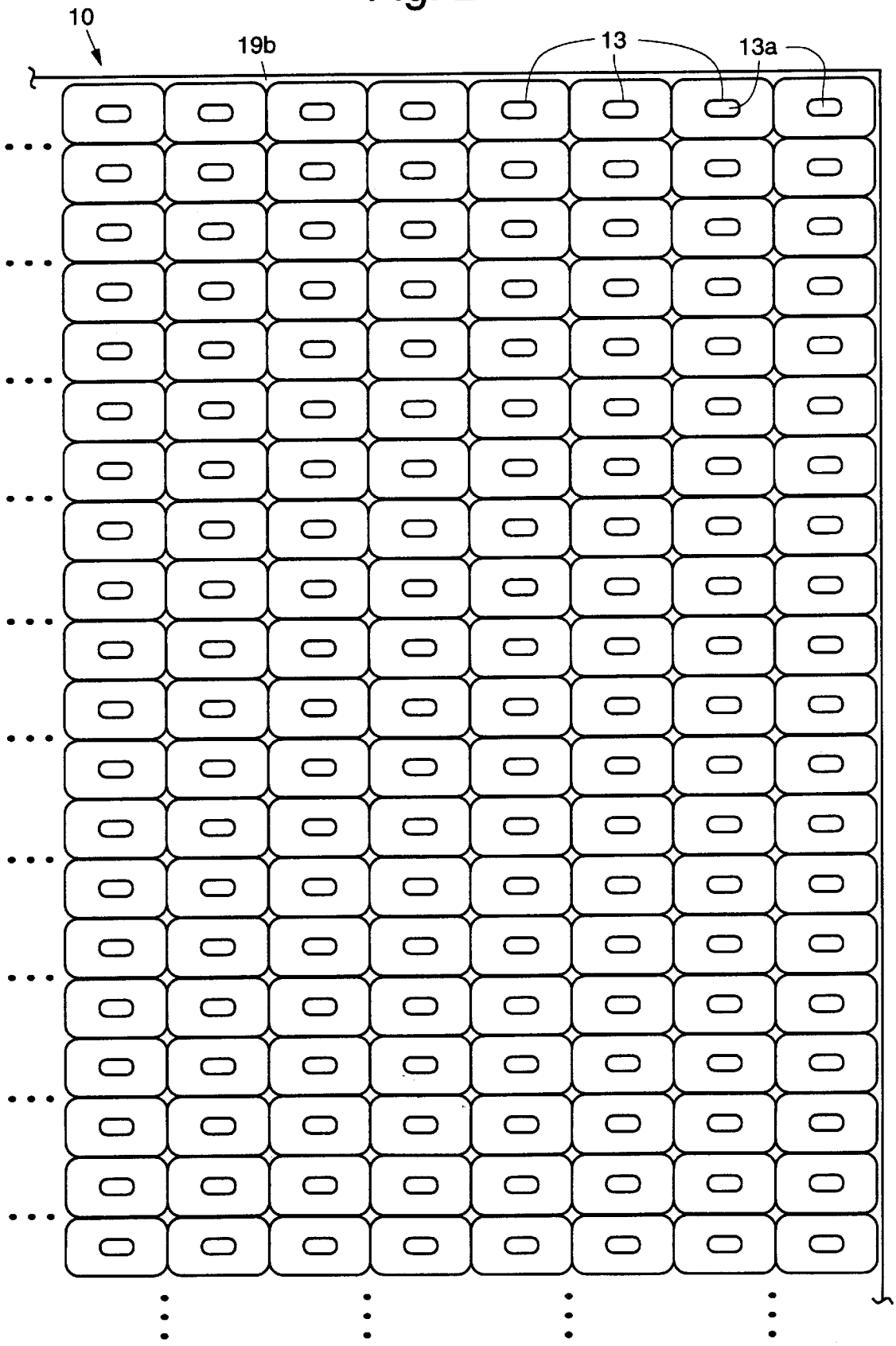
FIG. 2 illustrates a front view of the inverted boxhorn antenna array of FIG. 1.

Referring to the drawing figures, FIG. 1 illustrates an a rear view of a portion of an inverted boxhorn antenna array 10 in accordance with the principles of the present invention. FIG. 2 illustrates a front view of the inverted boxhorn antenna array 10 of FIG. 1. The exemplary inverted boxhorn antenna array 10 shown in FIGS. 1 and 2 has overall dimensions of 13.344 inches on each side and 0.849 inches in thickness.

The inverted boxhorn antenna array 10 comprises a power divider 11 and cover 12 comprising a flat sheet of metal having an input port 12*a* therein that is fastened with screws to a rear surface 19*a* of the power divider 11. The power divider 11 has a front surface 19*b* (FIG. 2) that forms a radiating surface of the array 10 and includes a plurality of antenna radiating elements 13, or boxhorn radiators 13 (512 for example). The power divider 11 is constructed from a single piece of metal. The power divider 11 is fabricated using a variety of different waveguide tee junctions 14, 15, 16 coupled between substantially identical 8-boxhorn inverted subarrays 20.

Figure 3A:
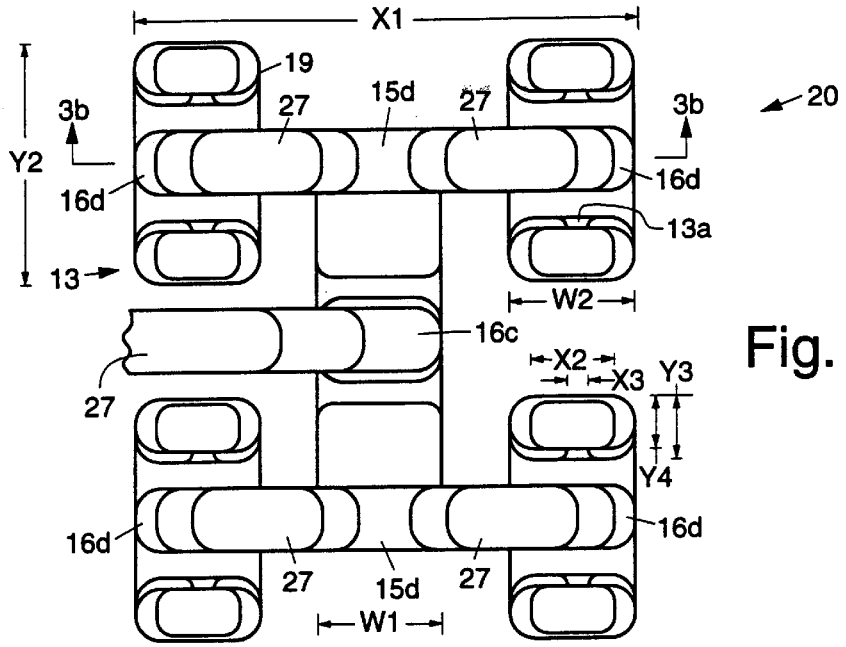
FIGS. 3*a* and 3*b* illustrate rear and cross-sectional side views, respectively, of an exemplary 8-boxhorn inverted subarray used in the inverted boxhorn antenna array.
Figure 3B:
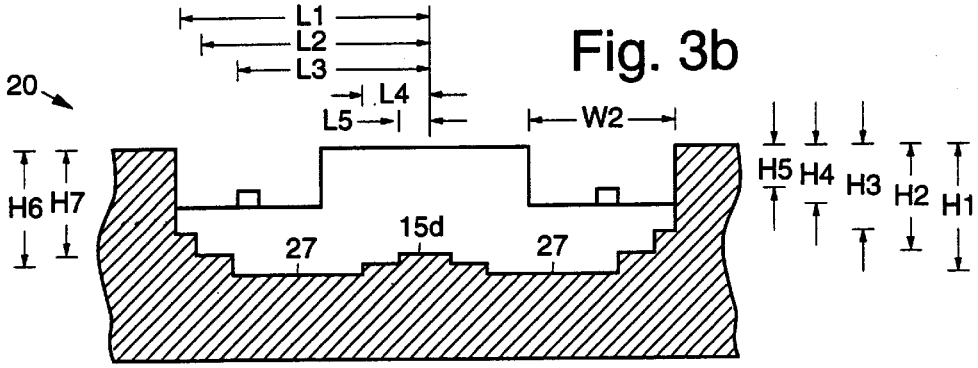

The waveguide tee junctions 14–16 include a central magic tee junction 14 for coupling energy from the single input port 12*a* in the cover 12 (flat sheet of metal) along two input paths of the power divider 11. A plurality of first folded series waveguide junctions 15*a* are used to transfer power from the central magic tee junction 14 along two opposed transverse paths of the power divider 11. FIGS. 3*a* and 3*b* illustrate an exemplary 8-boxhorn inverted subarray 20. Waveguide matched loads 27, comprising ferrite or other resistive material, are selectively disposed in waveguide channels of the power divider 11, and in particular between each of the inverted boxhorn radiators 13 of the 8-boxhorn inverted subarrays 20. The various waveguide junctions 14, 15, 16 and loads 27 are shown in and described in more detail with reference to FIGS. 3*a*, 3*b*, 4*a*, 4*b*, 5*a*, 5*b*, 6*a*, 6*b*, 7*a*, 7*b* and 8.

More specifically, the inverted boxhorn antenna array 10 is built up using a sequence of waveguide junctions 14–16 as follows in this example of a 512-way unit. The first junction is a central magic tee junction 14 with a waveguide load 27 on its shunt port 17*b*. The central magic tee junction 14 divides the RF power in half (i.e., a 1:2 power divider. In one series arm 14*c* of the magic tee junction 14, a 90 degree phase shift element 18 is installed in the rectangular waveguide section. The 90 degree phase shift element 18 is preferably a dielectric plate type phase shift element 18 which has a relatively low cost. In the opposite series arm 14*d*, nothing is disposed in the waveguide.

Power division is then performed to divide power to a ratio of 1:64. At the next power division, a first folded shunt tee junction 15*a* is used to divide the power by (½)*(½)=1:4. This is done in 2 places. At the next division, a first folded series tee junction 16*a* (4 places) divides power to 1:8. At the next division, a second folded shunt tee junction 15*b* (8 places) divides the power to 1:16. At the next division, a second folded series tee junction 16*b* (16 places) divides the power to 1:32. At the next division, a third folded shunt tee junction 15*c* (32 places) divides the power to 1:64.

There are three subsequent divisions that are made using certain of the above junction types, but with slightly modified internal dimensions to optimize return loss. The need for these slight modifications is due to complex electromagnetic interactions between the closely-spaced junctions. At the next division, a first special folded series tee junction 16*c* (64 places) divides the power to 1:128. At the next division, a special folded shunt tee junction 15*d* (128 places) divides the power to 1:256. At the next division, a second special folded series tee junction 16*d* (256 places) divides the power to 1:512. Side arms 15*d*-2 of the second special folded series tee junction 16*d* then excite a single-ridged waveguide 19 that terminates in an opening 13*a* (FIG. 2) at the bottom of the boxhorn radiator 13. Dimensions for each of the junctions 14, 15*a*, 15*b*, 15*c*, 15*d*, 16*a*, 16*b*, 16*c*, 16*d* and the inverted subarray 20 for an exemplary operating frequency range of 24.5–25.5 GHz are given in Table 1.

Referring now to FIGS. 3*a* and 3*b*, they illustrate enlarged rear and cross-sectional side views, respectively, of an exemplary 8-boxhorn inverted subarray 20 used in the inverted boxhorn antenna array 10 shown in FIGS. 1 and 2. Each 8-boxhorn inverted subarray 20 comprises eight boxhorn radiators 13, four second special folded series tee junctions 16*d*, two special folded shunt tee junctions 15*d*, and one first special folded series tee junction 16*c*.

The boxhorn array 20 utilizes the true-time-delay waveguide corporate power divider 11 (FIG. 1) which is a labyrinth of folded series and shunt waveguide junctions 41–16 interconnected by sections of waveguide. The folded construction is used so that the entire power divider 11 can be fabricated by machining or casting it from a single metal piece, which contributes to its low cost. Folding also contributes to a desirable thin shape of the antenna and reduces weight. In most embodiments, each waveguide junction 14–16 divides the power incident on a common port equally to two other ports.

Unequal power division between output arms may be accomplished, but in preferred embodiments of the present antenna 10, this has not been done, because the high gain associated with uniformly fed arrays is desired. All of the folded waveguide tee junctions 14–16 have been carefully optimized for low voltage standing wave ratio (VSWR). Each waveguide junction 14–16 has better than 23 dB return loss over a 12 percent frequency bandwidth.

Thus, in a typical 512-way power divider 11, nine successive waveguide junctions 14–16 are used. These junctions include the central magic tee junction 14, the first folded shunt tee junction 15*a*, the first folded series tee junction 16*a*, the second folded shunt tee junction 15*b*, the second folded series tee junction 16*b*, the third folded shunt tee junction 15*c*, the first special folded series tee junction 16*c*, the special folded shunt tee junction 15*d*, and the second special folded series tee junction 16*d*. Because of the true-time-delay characteristic of the power divider 11, the reflected signal from all waveguide junctions 14–16 arrives in phase with all other waveguide junctions 14–16 at the input port 12*a* of the array 10. This effect causes a high voltage standing wave ratio (VSWR) at the input port 12*a*. Therefore, unless other means are employed, extremely low voltage standing wave ratios are needed at each waveguide junction 14–16 to meet a low VSWR specification.

For example, for a maximum VSWR at the input port 12*a* of the array 10 of 1.5:1, a 512-way power divider 11 requires each waveguide junction 14–16 to have a VSWR of approximately: $1.5^{1/9}=1.046$. This is equivalent to a return loss of 33 dB. In a 4,096-way power divider 11, a waveguide junction return loss of 36 dB is needed. With any substantial RF bandwidth requirement, achievement of such low junction voltage standing wave ratio becomes virtually impossible to achieve in practice.

Nevertheless, well-matched waveguide junctions 14–16 are necessary to provide for good efficiency in the array 10. The unique folded waveguide junctions 14–16 used in the antenna 10 are described in detail below. These specially designed junctions 14–16 are used in the subarray 20 because the cascaded junctions are 14–16 electrically close to each other. The electromagnetic field modes necessary to fulfill complex boundary conditions result in significant interaction between the junctions 14–16 and require changes to the dimensions of matching devices at each junction compared to dimensions of the junctions 14–16 functioning alone. Specific dimensions are presented in Table 1 for a frequency range of 24.5–25.5 GHz. All of the waveguide junctions 14–16 may be readily machined using computer numerically controlled (CNC) milling machines from metal for prototyping purposes and all have been cast with metal using an investment casting process.

Figure 4A:
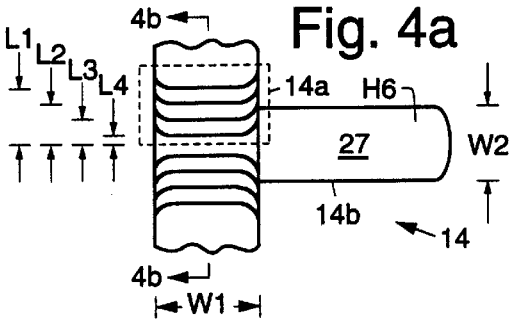
FIGS. 4*a* and 4*b* illustrate rear and cross-sectional side views, respectively, of a central series junction used in the inverted boxhorn antenna array.
Figure 4B:
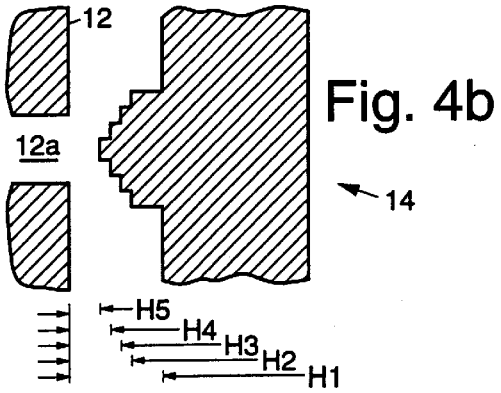

Referring to FIGS. 4*a* and 4*b*, they illustrate enlarged rear and cross-sectional side views, respectively, of the central magic tee junction 14 used in the inverted boxhorn antenna array 10 of FIG. 1. The central magic tee junction 14 is used at the input port 12*a* of the array 10. The central magic tee junction 14 comprises a fourstepped impedance transformer 14*a* (shown surrounded by a dashed box) located on a broad waveguide wall opposite a common arm 14*b* (or shunt port 14*b*) of the central magic tee junction 14. The return loss of the central magic tee junction 14 is better than 23 dB over the design frequency band.

Figure 5A:
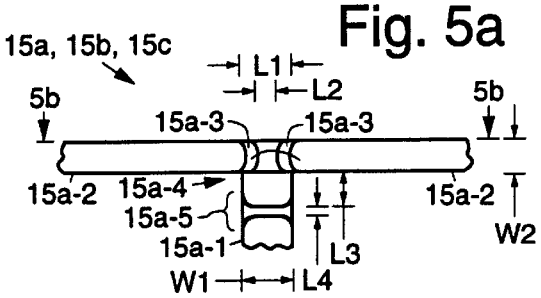
FIGS. 5*a* and 5*b* illustrate rear and cross-sectional side views, respectively, of a first folded series junction used in the inverted boxhorn antenna array.
Figure 5B:
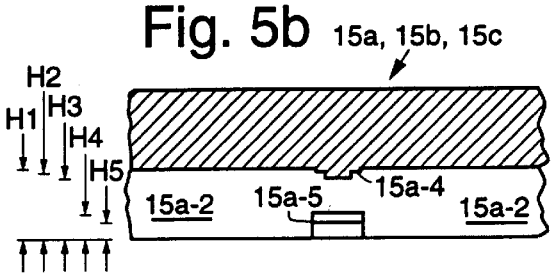

Referring to FIGS. 5*a* and 5*b*, they illustrate enlarged rear and cross-sectional side views, respectively, of the first, second and third folded shunt tee junctions 15*a*, 15*b*, 15*c* used in the inverted boxhorn antenna array 10 of FIG. 1. Each folded shunt tee junction 15*a*, 15*b*, 15*c* has its common port or arm 15*a*-1 rotated 90 degrees relative to the axis of its output ports 15*a*-2, thus folding the structure. Matching devices include a pair of irises 15*a*-3 adjacent to its tee junction 15*a*-4 in the output arms 15*a*-2 and a three-step impedance transformer 15*a*-5 in its common arm 15*a*-1. The return loss of each of the first, second and third folded shunt tee junctions 15*a*, 15*b*, 15*c* is better than 23 dB over the design frequency band.

Figure 6A:
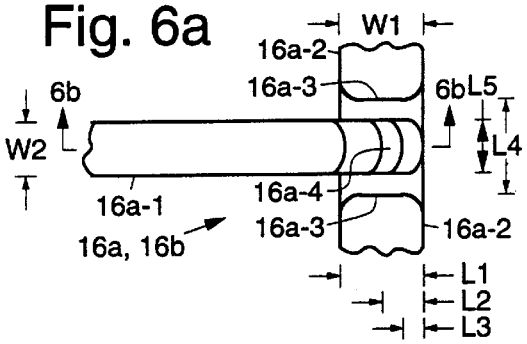
FIGS. 6*a* and 6*b* illustrate rear and cross-sectional side views, respectively, of a folded shunt junction used in the inverted boxhorn antenna array.
Figure 6B:
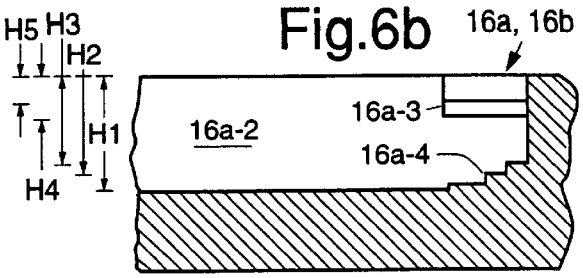

Referring to FIGS. 6*a* and 6*b*, they illustrate enlarged rear and cross-sectional side views, respectively, of the first and second folded series tee junctions 16*a*, 16*b* used in the inverted boxhorn antenna array 10 of FIG. 1. Each folded series tee junction 16*a*, 16*b* comprises a common or shunt port 16*a*-1 or arm 16*a*-1 that has been rotated 90 degrees to the axis of its output ports 16*a*-2 or arms 16*a*-2, thus folding the structure. Matching devices include an impedance transformer 16*a*-3 located in each output arm 16*a*-2 and a capacitive iris 16*a*-4 disposed in the common arm 16*a*-1. The return loss of the first and second folded series tee junctions 16*a*, 16*b* is better than 23 dB over the design frequency band.

Figure 7A:
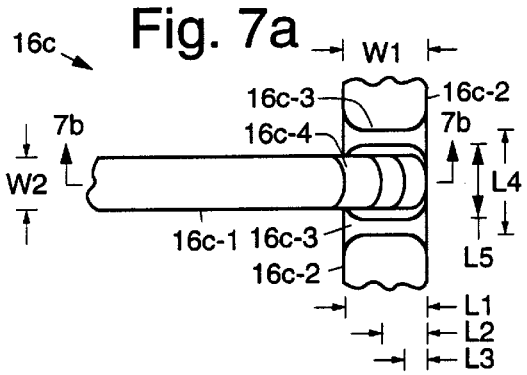
FIGS. 7*a* and 7*b* illustrate real and cross-sectional side views, respectively, of a first folded series junction used in the inverted boxhorn antenna array.
Figure 7B:
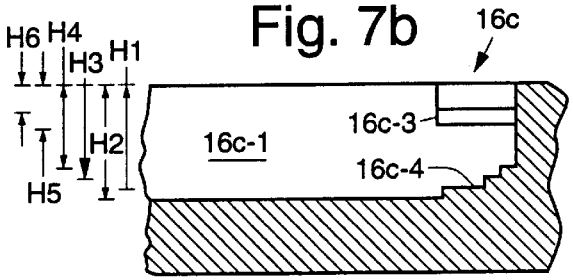

Referring to FIGS. 7*a* and 7*b*, they illustrate enlarged rear and cross-sectional side views, respectively, of the first special folded series tee junction 16*c* used in the inverted boxhorn antenna array 10 of FIG. 1. The first special folded series tee junction 16*c* used in the inverted subarray 20 comprises a common port 16*c*-1 (common arm 16*c*-1) has been rotated 90 degrees to the axis of its output ports 16*c*-2 (output arms 16*c*-2), thus folding the structure. Matching devices include a pair of posts 16*c*-3 and a three-step impedance transformer 16*c*-4 in its common arm 16*c*-2.

Figure 7C:
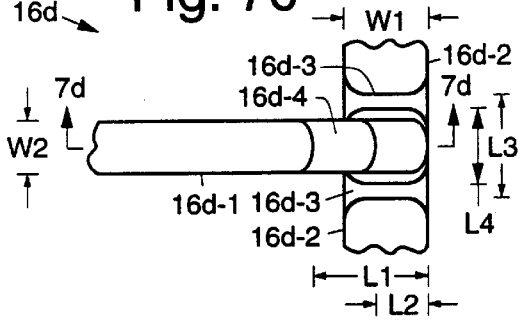
FIGS. 7*c* and 7*d* illustrate rear and cross-sectional side views, respectively, of a second folded series junction used in the inverted boxhorn antenna array.
Figure 7D:
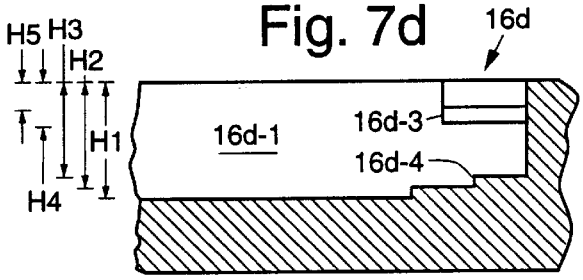

Referring to FIGS. 7*c* and 7*d*, they illustrate enlarged rear and cross-sectional side views, respectively, of the second special folded series tee junction 16*d* used in the inverted boxhorn antenna array 10 of FIG. 1. The second special folded series tee junction 16*d* used in the inverted subarray 20 comprises a series tee whose common port 16*d*-1 (common arm 16*a*-1) has been rotated 90 degrees to the axis of its output ports 16*d*-2 (output arms 16*a*-2), thus folding the structure. Matching devices include a pair of posts 16*d*-3 adjacent to an entrance to the boxhorn radiators 13 and a two-step impedance transformer 16*d*-4 in its common arm 16*d*-2. Dimensions of the second special folded series tee junction 16*d* are given in Table 1 with reference to FIGS. 3*a* and 3*b*.

In the inverted design of the boxhorn antenna 10, the output arms 16*d*-2 of the second special folded series junction 16*d* (adjacent to each boxhorn radiator 13) are rotated a further 90 degrees. These arms 16*d*-2 then connects to an opening 13*a* or feed slot 13*a* (FIG. 9) located at the base of each boxhorn radiator 13. Each arm 16*d*-2 is a single-ridged waveguide in cross-section, whose ridge is extended to form the matching posts 16*d*-3.

Figure 8A:
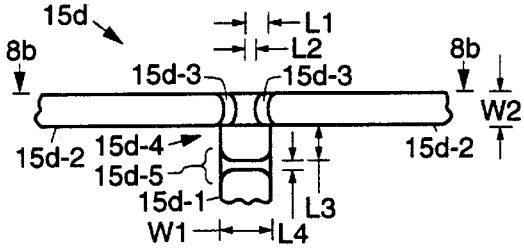
FIGS. 8*a* and 8*b* illustrate rear and cross-sectional side views, respectively, of a first folded series junction used in the inverted boxhorn antenna array.
Figure 8B:
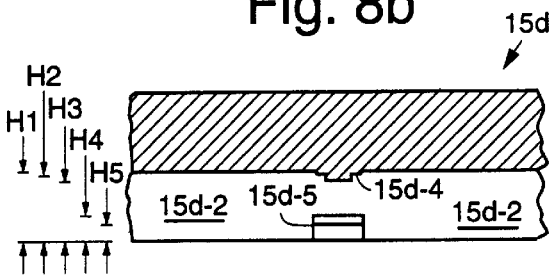

Referring to FIGS. 8*a* and 8*b*, they illustrate enlarged rear and cross-sectional side views, respectively, of the special folded shunt tee junction 15*d* used in the inverted boxhorn antenna array 10 of FIG. 1. The special folded shunt tee junction 15*d* has its common port or arm 15*d*-1 rotated 90 degrees relative to the axis of its output ports 15*d*-2, thus folding the structure. Matching devices include a pair of irises 15*d*-3 adjacent to its tee junction 16*a*-4 in the output arms 16*a*-2 and a three-step impedance transformer 15*d*-5 in its common arm 15*d*-1. The return loss of the first folded series tee junction 16*a* is better than 23 dB over the design frequency band.

The boxhorn radiator 13 formed at the radiating surface of the power divider 11 and is shown in FIG. 2. The dimensions for the boxhorn radiator 13 given in Table 1 result in optimum suppression of H-plane grating lobes when this element is used in a larger array 10. Swept return loss for the 8-boxhorn inverted subarray 20 is better than 18 dB.

Since the inherent VSWR of all true-time-delay arrays is high, components of the array 10 have been used to reduce the overall VSWR of the array 10. The first component is the magic tee junction 14. The magic tee junction 14 is a four-port waveguide junction that reduces the overall VSWR of the array 10. This is done by the shunt arms 14*b* having shunt junctions at respective ends thereof to the central magic tee junction 14 as is shown in FIG. 1.

When a nominal 90-degree phase shift element 18 is added to one output arm 14*c* of the central magic tee junction 14, the two reflected signals from the output arms 14*c*, 14*d* of the central magic tee junction 14 arrive in phase at the shunt arm 14*b* thereof. If the shunt arm 14*b* includes the waveguide matched load 27, the reflected signals are coupled to a shunt port of the shunt arm 17*b*, and they do not appear at the input port 12*a* of the array 10 and the apparent VSWR of the array 10 is reduced.

One effect of this approach is that two halves of the array 10 fed by output arms 14*c*, 14*d* of the central magic tee junction 14 are fed in phase quadrature (90 degrees). This results in a tilt of the beam generated by the array 10 away from the normal. The beam tilt is typically about 0.5 beamwidths (less than 1 degree in most arrays). This tilt is easily compensated at installation of the antenna array 10 by pointing the beam accordingly. When the quadrature phase shift is achieved by a simple waveguide path length change in one output arm of the central magic tee junction 14, the beam tilt change with frequency is quite small. Therefore for practical purposes, the array 10 does not squint. The net result of this VSWR mitigation approach is that the mismatch losses due to high VSWR are replaced by dissipation losses in the matched load 27 at the (fourth) shunt port 17*b* of the central magic tee junction 14.

The second approach is to use quadrature correction plate beam tilt compensation. If desired, a dielectric plate 18*a* (generally designated in FIG. 1) may be disposed over one half of the array 10 to compensate for the quadrature phase shift. This reduces the beam tilt to zero and improves the radiation pattern by making the first sidelobes symmetrical. For perfect compensation of the beam tilt with a reflectionless half-wave plate, a dielectric constant of 4.0 is necessary.

In practice, somewhat lower dielectric constant materials may be utilized, such as Lexan polycarbonate with a dielectric constant of about 2.75, for example. A half-wave wall of this material has an insertion phase delay of about 70 degrees. In this case, a designer has two options. The first option is to use a 90 degree phase shift element 18 and a dielectric plate 18*a* that shifts the phase by 70 degrees to produce a typical beam squint of 0.2 degrees and a typical beam squint/high power bandwidth (HPBW) of 0.1, which results in ideal VSWR mitigation. The second option is to use a 70 degree phase shift element 18 and a dielectric plate 18*a* that shifts the phase by 70 degrees to produce a typical beam squint of 0 degrees and a typical beam squint/HPBW of 0, which results in slightly reduced VSWR mitigation. Therefore, either option offers a practical solution to the beam tilt compensation and both can be acceptable depending on the specifications that are to be met.

The radiation patterns from the boxhorn array 10 are readily determined by antenna theory. In the array 10, the total pattern is the product of the field pattern of the boxhorn radiators 13 and of an array factor. The array factor is the expression which accounts for the complex addition of all signals from the array elements. The total pattern is determined by the pattern of boxhorn radiators 13. If the boxhorn radiators 13 are flared in the E-plane, the array 10 may be expanded in size. Due to the limitations in the element pattern of the boxhorn radiators 13, however, there is a fixed H-plane element spacing for a given frequency band.

Therefore, boxhorn arrays 10 have relatively fixed sizes. With a true-time-delay power divider 11, only arrays with binary number of elements may be employed and the array dimensions are available only in modular sizes. For example, a 512-element army naturally has 16 elements in the H-plane and 32 boxhorn radiators 13 in the E-plane. The E-plane array dimension can be expanded by about 15 percent from that of a closely-spaced E-plane configuration. Expansions greater than 15 percent can cause grating lobes in the E-plane with consequent gain losses and high sidelobes and are therefore avoided in designs.

Boxhorn radiators 13 are dimensioned to place an element pattern null at the H-plane first grating lobe angle. This angle is designated "ThetaG" and is given by the expression $$\mathrm{SIN}(\mathrm{ThetaG})=0.5*\mathrm{wavelength}/\mathrm{boxhorn\ pitch},$$

where the boxhorn pitch is the inside width of the boxhorn plus the H-plane wall thickness and the wavelength is expressed in the same dimensions.

The Silver reference mentioned in the Background section indicates that the boxhorn pattern is calculated from the following parameters: H-plane width, feed slot width, boxhorn depth and inside comer radius in the boxhorn. Calculations show that an element pattern null can be placed at the ThetaG grating lobe angle by suitable choices of these parameters. When this is done, the grating lobe magnitude can be greatly suppressed. Calculations show that this grating lobe can be suppressed to better than −18 dB over a 12 percent frequency bandwidth. At the band center, grating lobe suppression of better than 25 dB can be attained.

Figure 9:
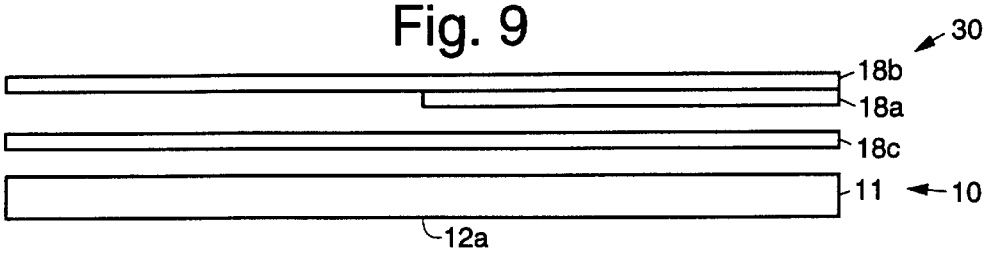
FIG. 9 illustrates a side view of an exemplary fully-configured antenna assembly in accordance with the present invention.

It should be noted that these grating lobes appear in the principal H-plane of the array 10. When a 45-degree transmission type twist polarizer (not shown) is employed with the inverted boxhorn antenna array 10, these grating lobes do not appear in the horizontal plane. For the purposes of completeness, a side view of a fully-configured antenna assembly 30 is shown in FIG. 9, and includes a radome cover 18*b* (generally designated in FIG. 1), which can be vacuum-formed or injection molded plastic such as Lexan polycarbonate, for example, a quadrature correction plate 18*a*, which also may be vacuum-formed or injection molded plastic, for example, and a twist polarizer 18*c* (generally designated in FIG. 1). The radome cover 18*b* may be comprised of a series of laminated plastic sheets each having a set of metal strips formed thereon. As is shown in FIG. 9, the twist polarizer 18*c*, quadrature correction plate 18*a* and the radome cover 18*b* are stacked in front of the inverted boxhorn antenna array 10 shown in FIGS. 1 and 2. The quadrature correction plate 18*a* covers one half of the inverted boxhorn antenna array 10. The quadrature correction plate 18*a* and the radome cover 18*b* may be bonded together. The twist polarizer 18*c* is typically separated from adjacent surfaces of the quadrature correction plate 18*a* and the inverted boxhorn antenna array 10 by a small gap.

One of the main advantages of boxhorn arrays 10 is that for a given array size, only one-half the number of radiating elements (boxhorn radiators 13) is needed when compared with a conventional arrangement of simple waveguide slots. This greatly simplifies the design of the true-time-delay power divider 11 by halving the number of waveguide junctions 14–16 that are required. In effect, the same performance is gained with half the complexity and at reduced costs.

Some applications require that multiple boxhorn arrays 10 be joined to form a larger higher-gain antenna. Array theory readily predicts the pattern performance of such enlarged arrays 10. For example, a two-array system having two square arrays 10 joined at one edge and oriented 45-degrees to the plane of the pattern. This array 10 also has greatly suppressed 45-degree-plane sidelobes. This make it very useful in commercial line-of-sight microwave links which require this type of performance to reduce interference with other nearby stations. Such sidelobe performance is regulated by the FCC, the DTI in the UK, and other government agencies. Furthermore, arrays of inverted boxhorn arrays 10 having aspect ratios of 1:1 will have the same types of radiation patterns with low diagonal plane sidelobes as individual arrays 10 except for narrower beamwidths and higher gains.

Calculations show that individual arrays 10 need not butt against their neighbors. Array theory predicts that low sidelobes are still generated in diagonal planes even with separation of 10–20 percent of the size of the array 10. This effect permits expansion of the antenna to narrow the overall beamwidth.

The present invention enables digital communications systems to be designed, manufactured, sold and installed into local communities where modern Personal Communications Systems are being implemented. In the US, major communications companies are developing high performance wireless telephones, Internet links and wideband data. Because digital radios used in this type of communications infrastructure must be installed locally, there are great numbers of them. Communities where installations of such radios have been installed have esthetic concerns about the proliferation of unsightly towers and parabolic dish antennas in their neighborhoods.

The present invention greatly improves the appearance of typical digital radios, thus lessening the concerns of the local communities. Therefore, a digital network utilizing these radios is more likely to be implemented in a speedy, cost-effective and technically compliant manner. Another factor is that the digital radios are highly regulated for their technical characteristics. For antennas used thereby, the gain, sidelobes and cross-polarization are established by governmental regulatory bodies. Many countries have slightly differing technical requirements, but their communication officials all want to have the best possible technical performance for installations within their countries so as to improve their infrastructure and ensure that it will not easily become obsolete. The present invention helps to meet these goals while permitting cost-effective production of antennas for use in these radios.

Therefore, the present invention addresses major issues of esthetics, modernizing of national communications infrastructures, local acceptability of the equipment, high technical performance which meets or is better than the regulatory requirements, low product cost and ease of manufacture and installation in the large quantities required for these digital radios.

The magic tee junction 14, the shunt tee junctions 15*a*, 15*b*, 15*c* and the series tee junctions 16*a*, 16*b* are independent and do no interact with other junctions. In the above exemplary antenna array 10, these independent junctions stop at the third shunt tee junction 15*c*. However, in general, such shunt and series junctions 15*a*, 15*b*, 15*c*, 16*a* , 16*b* may be cascaded to form larger or smaller arrays 10 by adding or subtracting alternating shunt and series junctions 15, 16. The final three special folded junctions 16*c*, 16*d*, 15*d* interact with one another and form the final 8-way portion of the power divider 11.

Thus, improved inverted boxhorn antenna arrays have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An boxhorn antenna array comprising:

a power divider having a front surface that forms a radiating surface of the array, and a rear surface, and wherein the power divider comprises a central magic tee junction and a plurality of alternating folded shunt and folded series tee junctions that couple energy from the central magic tee junction to a plurality of boxhorn subarrays having boxhorn radiators formed at the radiating surface of the array; and a cover fastened to the rear surface of the power divider having an input port that is coupled to the central magic tee junction of the power divider.

2. The array of claim 1 wherein the cover comprises a flat sheet of metal having the input port therein that is fastened to a rear surface of the power divider.

3. The array of claim 1 wherein the power divider is fabricated from a single piece of metal.

4. The array of claim 1 further comprising waveguide matched loads disposed in waveguide channels between each of the boxhorn radiators of the boxhorn subarrays.

5. The array of claim 1 further comprising:

a twist polarizer disposed in front of the radiating surface of the power divider;

a quadrature correction plate disposed in front of the twist polarizer; and a radome cover disposed in front of the quadrature correction plate.

6. The array of claim 5 wherein the twist polarizer is from adjacent surfaces of the quadrature correction plate and the boxhorn antenna array by a small gap.

7. The array of claim 5 wherein the quadrature correction plate is comprised of plastic.

8. The array of claim 5 wherein the radome cover is comprised of a series of laminated plastic sheets each having a set of metal strips formed thereon.

9. The array of claim 5 wherein the twist polarizer is comprised of plastic.

10. An antenna assembly comprising:

a power divider having a front surface that forms a radiating surface of the array, and a rear surface, and wherein the power divider comprises a central magic tee junction and a plurality of alternating folded shunt and folded series tee junctions that coupled energy from the central magic tee junction to a plurality of boxhorn subarrays having boxhorn radiators formed at the radiating surface of the array, and a cover fastened to the rear surface of the power divider having an input port that is coupled to the central magic tee junction of the power divider;

a twist polarizer disposed in front of the radiating surface of the power divider;

a quadrature correction plate disposed in front of the twist polarizer; and a radome cover disposed in front of the quadrature correction plate.

11. The antenna assembly of claim 10 wherein the cover comprises a flat sheet of metal having the input port therein that is fastened to a rear surface of the power divider.

12. The antenna assembly of claim 10 wherein the power divider is fabricated from a single piece of metal.

13. The antenna assembly of claim 10 further comprising waveguide matched loads disposed in waveguide channels between each of the boxhorn radiators of the boxhorn subarrays.

14. The antenna assembly of claim 10 wherein the twist polarizer is from adjacent surfaces of the quadrature correction plate and the boxhorn antenna array by a small gap.

15. The antenna assembly of claim 14 wherein the quadrature correction plate is comprised of plastic.

16. The antenna assembly of claim 14 wherein the radome cover is comprised of a series of laminated platic sheets each having a set of metal strips formed thereon.

17. The antenna assembly of claim 14 wherein the twist polarized is comprised of plastic.

* * * * *